US005402141A

United States Patent [19]

Haim et al.

[11] Patent Number: 5,402,141

[45] Date of Patent: Mar. 28, 1995

[54] MULTIGAP LIQUID CRYSTAL COLOR DISPLAY WITH REDUCED IMAGE RETENTION AND FLICKER

[75] Inventors: Elias S. Haim, Glendale, Ariz.; Tomihisa Sunata, Miki, Japan

[73] Assignee: Honeywell Inc., Minneapolis, Minn.

[21] Appl. No.: 964,102

[22] Filed: Oct. 16, 1992

Related U.S. Application Data

[63] Continuation-in-part of Ser. No. 850,174, Mar. 11, 1992, abandoned.

[51] Int. Cl.[6] ..... G09G 3/36

[52] U.S. Cl. ..... 345/88; 359/68; 345/95

[58] Field of Search ..... 340/784, 793; 359/57, 359/59, 68; 345/87, 88, 89, 92, 95

[56] References Cited

U.S. PATENT DOCUMENTS

| | | | |
|---|---|---|---|
| 4,431,271 | 2/1984 | Okubo | 340/784 |
| 4,632,514 | 12/1986 | Ogawa et al. | 359/68 |
| 4,642,619 | 2/1987 | Togashi | 340/784 |
| 4,675,667 | 6/1987 | Nakamura et al. | 340/784 |
| 4,712,877 | 12/1987 | Okada et al. | 340/793 |
| 4,762,398 | 8/1988 | Yasui et al. | 340/784 |
| 4,810,060 | 3/1989 | Ukai | 359/59 |
| 4,828,365 | 5/1989 | Stewart et al. | 359/68 |
| 4,934,791 | 6/1990 | Shimizu et al. | 359/68 |
| 5,151,805 | 9/1992 | Takeda et al. | 359/57 |
| 5,162,901 | 11/1992 | Shimada et al. | 359/59 |

*Primary Examiner*—Alvin E. Oberley
*Assistant Examiner*—Gin Goon
*Attorney, Agent, or Firm*—Seymour Levine; Dale E. Jepsen; Albin Medved

[57] ABSTRACT

A multigap liquid crystal color display having RED, GREEN and BLUE pixels with TFT activating transistors and with the pixels being constructed and arranged so that the offset voltages at the RED, GREEN and BLUE pixels induced by the gate pulses applied to the TFTs are equalized. In one embodiment, the pixel storage capacitors are customized to equalize the offset voltages. In a second embodiment, the pixel areas are adjusted so as to provide the offset voltage equalization.

10 Claims, 6 Drawing Sheets

MULTIGAP LIQUID CRYSTAL COLOR DISPLAY WITH REDUCED IMAGE RETENTION AND FLICKER

This is a continuation-in-part of application Ser. No. 07/850,174, filed Mar. 11, 1992, now abandoned.

BACKGROUND OF THE INVENTION

1. Field of the Invention

The invention relates to displays particularly with respect to liquid crystal, multigap color displays. Such displays typically are of active matrix configuration.

2. Description of the Prior Art

Backlighted liquid crystal displays (LCD) utilizing twisted-nematic (TN) liquid crystal have been developed to provide flat panel displays for applications such as aircraft instrumentation, laptop and notebook computers, and the like. Such LCDs typically utilize a back electrode structure in the form of a matrix of transparent metal pixels or dot electrodes and a continuous transparent metal front electrode with the liquid crystal material sandwiched therebetween. The front electrode is often denoted as the common or counter electrode. Each pixel electrode is activated through a switch, usually implemented as a thin film transistor (TFT), which is deposited as a field effect transistor (FET). The drain electrode of each TFT is connected to, or actually forms, the pixel electrode with which it is associated. The gate electrodes of the TFTs in each row of the matrix are commonly connected to a gate bus-line for the row and the source electrodes of the TFTs in each column of the matrix are commonly connected to a source bus-line for the column. An image is created in raster fashion by sequentially scanning the gate bus rows while applying information signals to the source bus columns.

As is known, such LCDs are prone to anomalous image retention and flicker caused by parasitic capacitance between the gate and drain electrodes of the TFTs. The gate bus scanning pulses charge the parasitic capacitance to an offset DC voltage that results in image retention. In such LCDs, the cell gap between the back pixel electrode and the front common electrode for each pixel cell is usually uniform across the display. Such an LCD is denoted as a monogap display. A DC bias voltage is applied to the common electrode to compensate for the offset voltage so as to reduce the image retention and flicker anomaly. In other words, the DC bias voltage is applied to the counter electrode as compensation to minimize the net DC voltage across the pixel electrodes.

Color capability is imparted to the LCD by grouping the pixels into color groups such as triads, quads, and the like, and providing color filters at the front surface of the LCD to intercept the light transmitted through the respective pixels. For example, triads with primary color RED, GREEN and BLUE filters are often utilized. By appropriate video control of the gate and source buses various colors are generated.

Color LCDs are usually manufactured with a uniform cell gap for all color dots across the display active area. Because of the properties of TN color monogap LCDs, a different level of off-state luminance occurs for each of the color dots. This phenomenon results in undesirably high levels of background luminance. The condition is exacerbated when the display is viewed from varying angles since each color dot changes luminance with viewing angle at different rates, some increasing and some decreasing. The result is objectionably different chromaticities of background color for various angles of view. Additionally, this aspect of monogap LCD technology results in high levels of background luminance with viewing angle, producing undesirable secondary effects in viewability of display symbology.

Specifically, a RED, GREEN, BLUE (RGB) multicolor display requires an illumination source having strong spectral emissions at 435 nm, 545 nm, and 610 nm. It is impossible to obtain minimum background (off) transmission for all three wavelengths utilizing a display configured with a single cell gap. In such a monogap display, emissions from at least two of the three wavelengths leak through the display background resulting in increased background luminance. This, in turn, results in reduced contrast and a chromatic background.

The solution to the problem of background luminance and chromaticity is to use a multigap display with different cell gaps for individual wavelengths. In other words, for each color, the liquid crystal cell is constructed such that each cell gap is set to minimize off-state cell transmission for that color.

Such a multigap display construction permits dots to be more fully extinguished, producing more saturated, stable primary colors over the viewing angle. Any chromaticity of background, including achromatic, can be obtained with the multigap technology through the selection of different color dyes for each of the primary colors, selecting the appropriate cell gap for each primary color. Once the selection is made, the resulting chromaticity remains consistent over all viewing angles. Thus, a multigap display exhibits a consistent and predictable mixture of primary colors over the viewing angles which results in unchanging chromaticity, providing, if desired, an achromatic background over all viewing angles. This is unlike the monogap display which suffers from the deficiencies discussed above.

The multigap construction is effected by utilizing various thicknesses for the primary color filters. Since the counter electrode is disposed at the rear of the filters, the appropriate differing gaps are formed with respect to the back pixel electrodes.

Notwithstanding the advantages of the multigap technology in eliminating the background luminosity and chromaticity problem of the monogap display, the multigap construction exacerbates the image retention and flicker problems. In a multigap display, the primary color pixels have different cell gaps to maximize the off-state optical performance as discussed above. The differing gaps result in differing capacitance values for the primary color pixels. This construction makes it impossible to compensate for the gate-drain capacitance/gate voltage induced DC voltage with a single DC bias voltage resulting in image retention and flicker. There is no single counter electrode voltage capable of compensating for the different induced DC voltages on the primary pixels. For example, in an RGB triad display, if a bias voltage is selected to minimize GREEN DC, increased DC is generated in the BLUE and RED pixels.

SUMMARY OF THE INVENTION

The above image retention and flicker disadvantage is obviated by a multigap liquid crystal color display comprising a plurality of pixels, each pixel having a pixel electrode facing a common electrode. A plurality of transistor switches actuate the respective pixel electrodes. Preferably, the transistors are TFTs. The TFT gate actuation pulses induce an offset voltage at the pixel electrodes that would result in undesirable image retention. The pixels include first and second pixels for generating respective first and second colors, the first and second pixels having different respective cell gaps. Thus, the first and second pixels exhibit first and second respective capacitances resulting in first and second respective offset voltages at the pixel electrodes of the first and second pixels. The pixel electrodes of the first and second pixels are constructed and arranged so that the first and second offset voltages are equal with respect to each other. Bias voltage is applied to the common electrode to reduce the offset voltage to zero.

An RGB triad display utilizes RED, GREEN and BLUE generating pixels with storage capacitors. The storage capacitors are custom-designed with respect to the RED, GREEN and BLUE pixels so that the offset voltages induced thereat are equal. Alternatively, the areas of the pixel electrodes of the RED, GREEN and BLUE pixels are adjusted so as to equalize the offset voltages.

In a further embodiment of the invention, the offset voltages are equalized by custom designing the storage capacitors respectively associated with the pixels and adjusting the respective gate-drain capacitances of TFTs so that the ratio of the gate-drain capacitance to the sum of the storage and gate-drain capacitances with the corresponding pixel capacitance are equal for the RED, GREEN, and BLUE pixels.

In another embodiment of the invention, the offset voltages are equalized by custom designing the storage capacitors, adjusting the areas of the pixel electrodes to alter the capacitance thereof, and adjusting the gate-drain capacitance of the TFTs so that the ratios of the storage capacitors respectively associated with the pixels are equal to the ratios of the pixel electrode capacitances and to the ratios of the gate-drain capacitance of the respectively associated TFTs.

DESCRIPTION OF THE PREFERRED EMBODIMENTS

Figure 1:
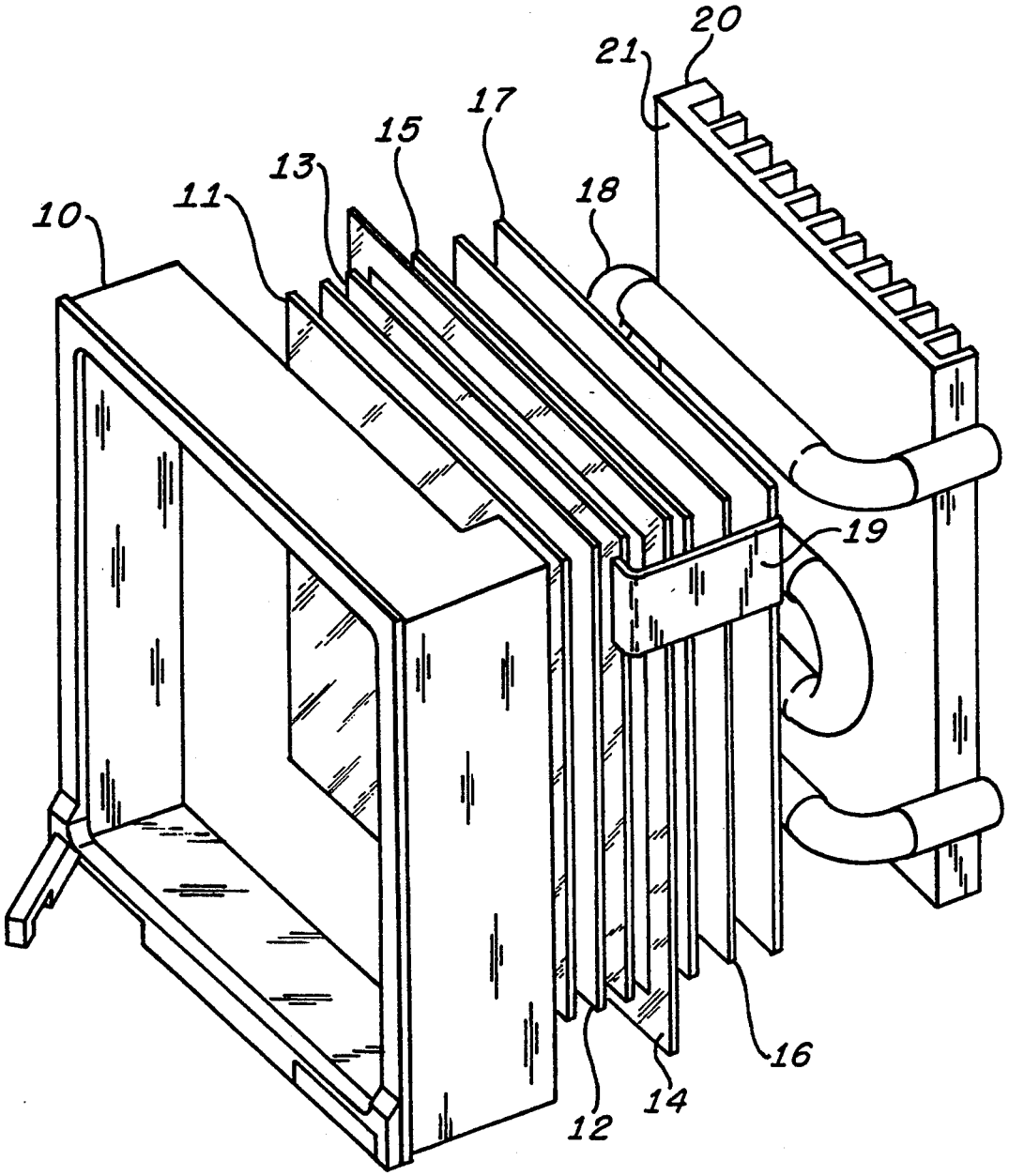
FIG. 1 is an exploded three-dimensional view of an LCD module assembly.

Referring to FIG. 1, and LCD module assembly is illustrated. The components of the LCD are contained in a protective housing 10 and the display is viewed through a glass front plate 11 with an anti-reflective coating. Adjacent the front plate 11 is a front polarizer 12 of the LCD. Adjacent the front polarizer 12 is the LCD glass assembly comprised of a color filter upper glass substrate 13 and an active matrix TFT lower glass substrate 14. In the assembled device, liquid crystal material is captured between the substrates 13 and 14. Further details of the substrates 13 and 14 are illustrated in FIGS. 2, 3, 6 and 7.

A rear polarizer 15 of the LCD is disposed adjacent the :substrate 14 followed by a heater 16. A directional diffuser assembly 17 is located behind the rear polarizer 15 for diffusing light transmitted therethrough from a lamp assembly 18. A flexible interconnect 19 is illustrated for holding the layers 13–17 together. In the preferred embodiment of the invention, the lamp 18 provides strong spectral emissions at 435 nm, 545 nm, and 610 nm for providing the BLUE, GREEN and RED primary colors, respectively, for the LCD. A heat dissipation assembly 20 with a reflective surface 21 closes the back of the LCD module assembly.

In a well known manner, the back light from the lamp 18 is controllably transmitted through the LCD glass assembly 13,14 through the triad color filters of the filter assembly 13 to form the color image viewed through the front glass plate 11.

Figure 2:
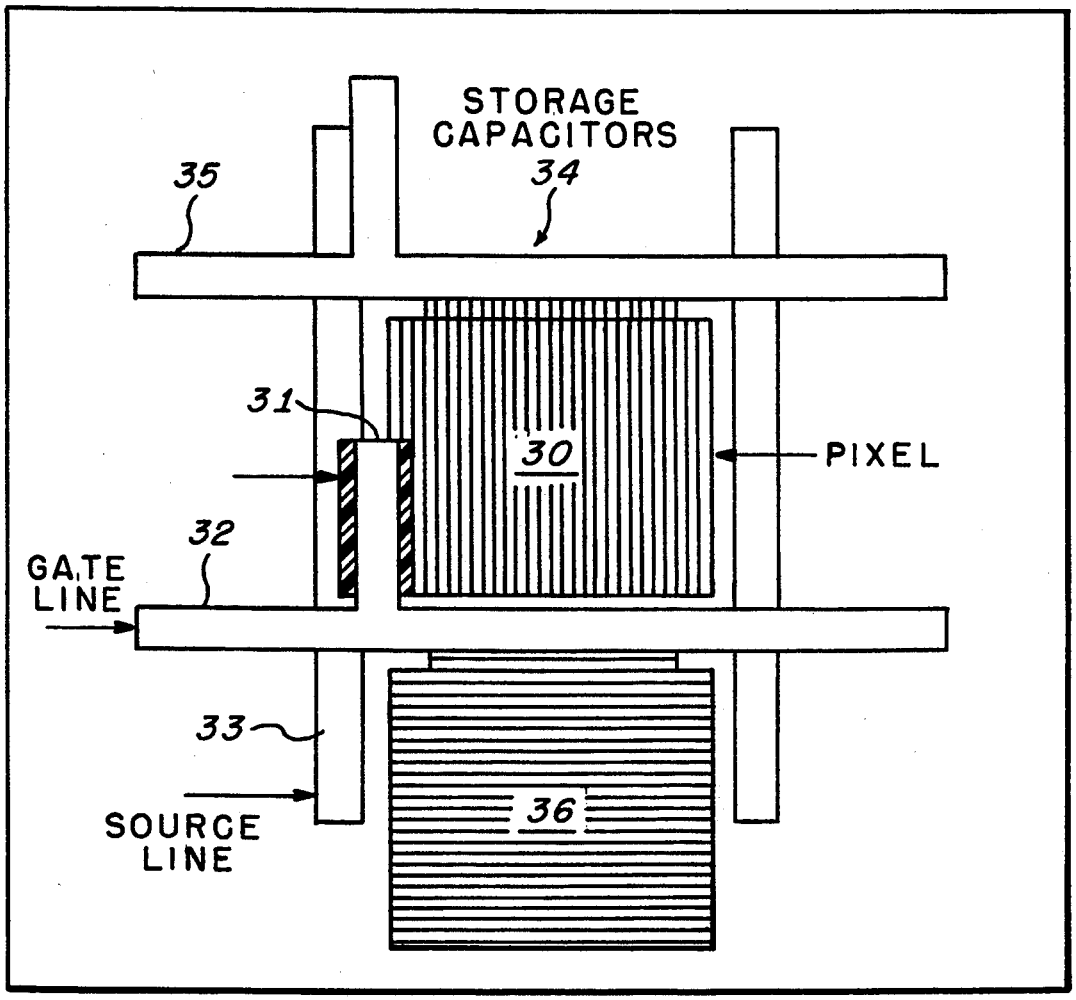
FIG. 2 is a plan view of the TFT substrate of FIG. 1 illustrating the pixel structure of the LCD.

Referring to FIG. 2, further details of the TFT substrate 14 are depicted. A typical pixel electrode 30 (back electrode) along with an activating TFT 31 is illustrated. As is known, the pixel electrode 30 comprises the drain electrode of the TFT 31. The gate electrode of the TFT 31 is connected to a gate bus-line 32 and the source electrode of the TFT 31 is connected to a source bus-line 33. A portion of the amorphous silicon (a-Si) layer of the TFT structure is illustrated. It is appreciated that the gate bus 32 is connected to the gate electrodes of all of the TFTs in the matrix row containing the pixel electrode 30. Similarly, the source bus 33 is connected to the source electrode of all of the TFTs in the matrix column containing the pixel electrode 30.

Typically, each of the pixel electrodes, such as the electrode 30, is comprised of transparent metal such as indium tin oxide (ITO). As is furthermore well known, storage capacitors are associated with each of the pixel electrodes. For example, storage capacitors 34 are connected with the pixel electrode 30 and are formed with gate line 35 which provides an electrode thereof. The other storage capacitor electrodes are formed by extension of the pixel electrode 30 as illustrated. The storage capacitors are utilized to retain the voltage on the pixel between refresh pulses and to increase the capacitance of the pixel to minimize the offset voltage at the drain electrode. It is appreciated that the storage capacitors of the pixels that are connected to the $n^{th}$ gate bus-line are formed between the pixel electrodes of the $n^{th}$ gate bus-line and the $(n-1)^{th}$ gate bus-line. Thus, the storage capacitors 34 for the pixel electrode 30 connected to the gate bus-line 32 are formed with gate bus-line 35. It is appreciated therefore, that the electrodes of the storage capacitors 34 are ITO (pixel electrode) and gate bus-line metal, respectively. It is furthermore appreciated that the insulator of the storage capacitors 34 is the same as the gate insulator in a manner to be clarified with respect to FIG. 3. A pixel electrode 36 in the same column as the pixel electrode 30, is illustrated.

Figure 6:
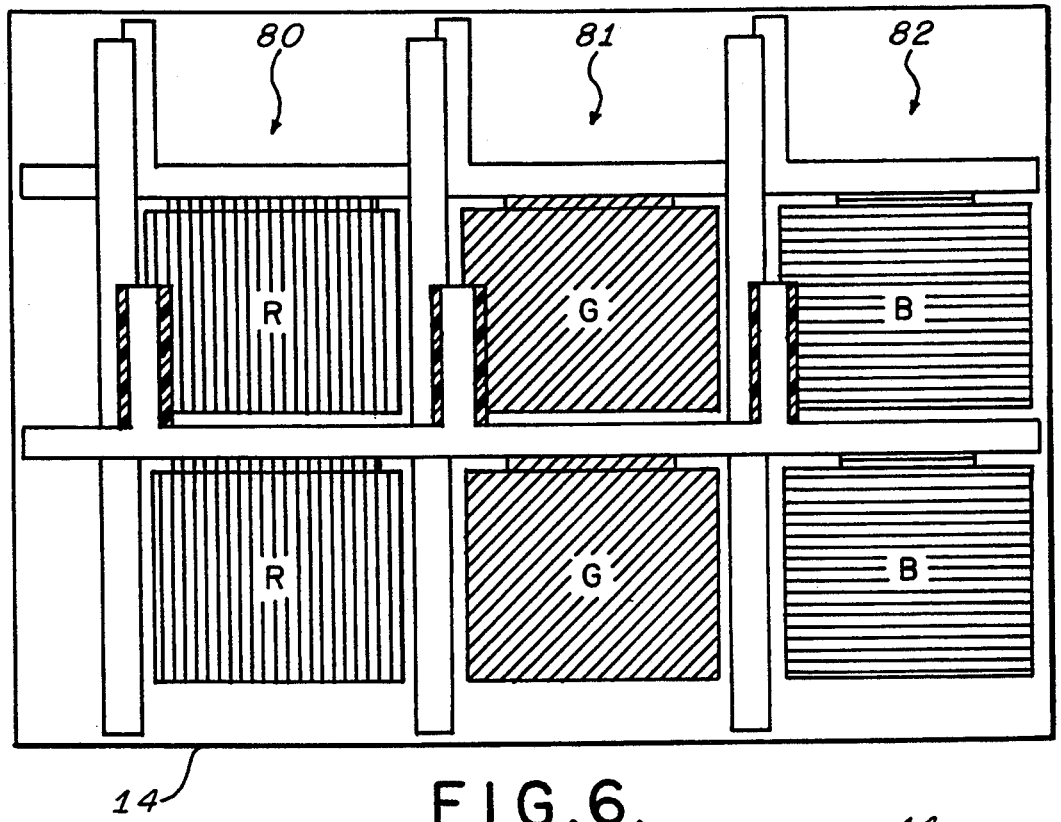
FIG. 6 is a plan view of the TFT substrate, similar to FIG. 2, illustrating the custom storage capacitors in accordance with the invention.
Figure 7:
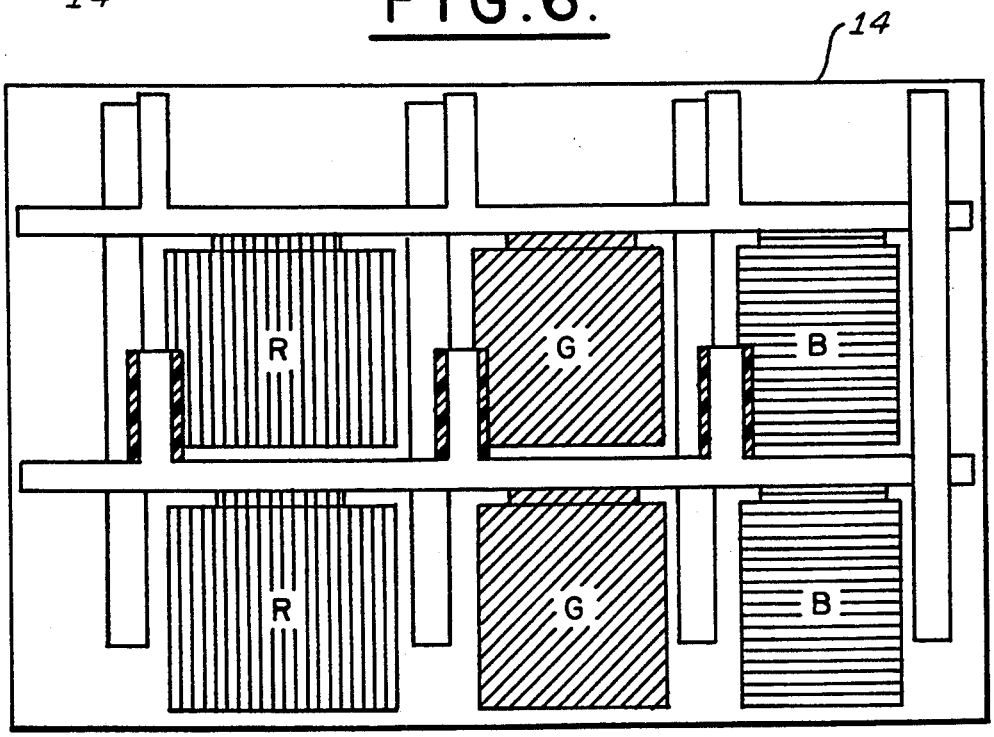
FIG. 7 is a plan view of the TFT substrate, similar to FIG. 2, illustrating modified pixels in accordance with the invention.

In accordance with the invention, and in a manner to be illustrated in FIGS. 6 and 7, the diverse capacitances of the primary color pixels of the multigap LCD structure are equalized by customizing the storage capacitors thereof. Alternatively, the diverse capacitances of the primary color pixels of the multigap LCD structure may be equalized by tailoring the sizes of the pixel electrodes thereof.

Figure 3:
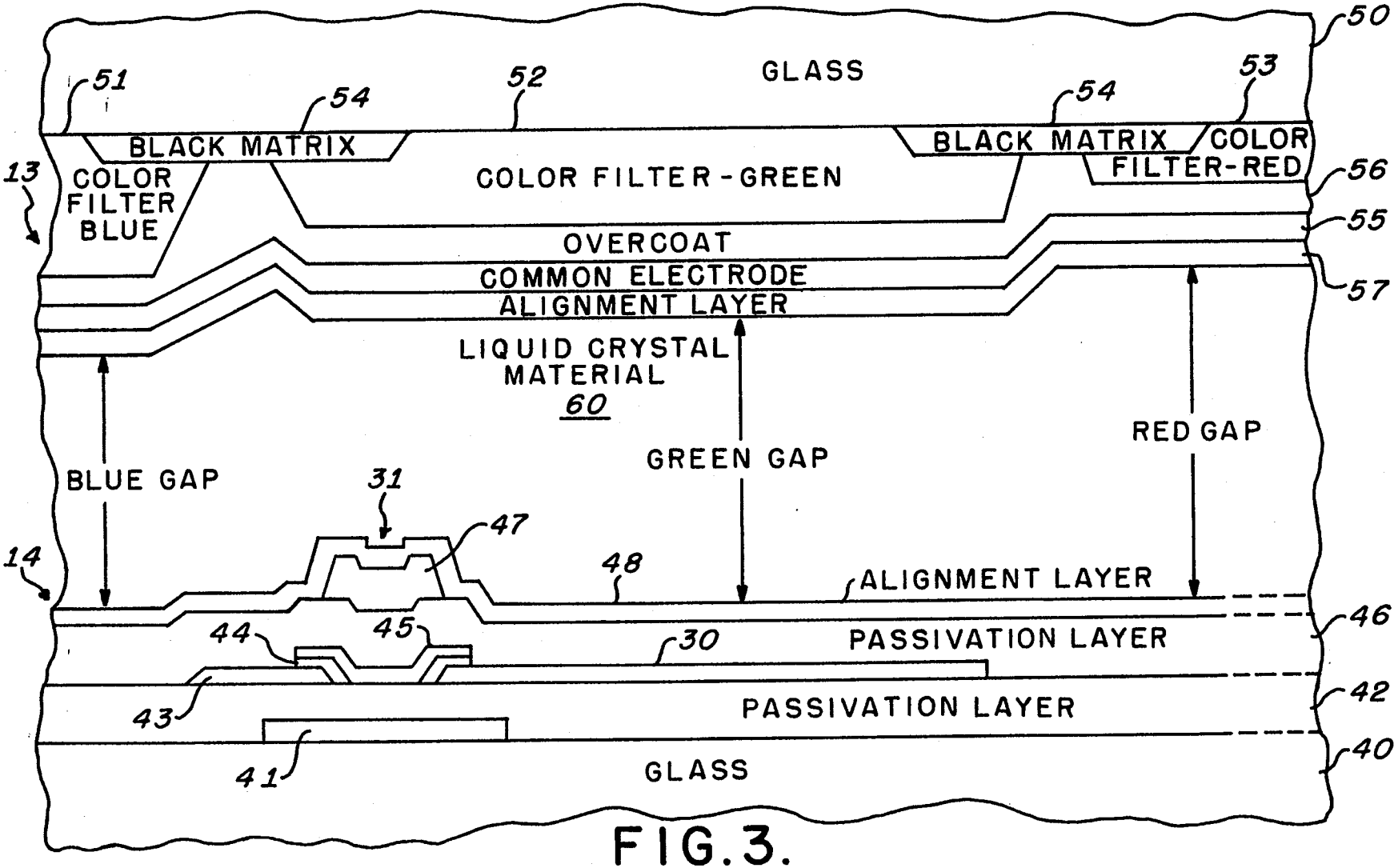
FIG. 3 is an elevation view in cross section illustrating the LCD structure of FIG. 1.

Referring to FIG. 3, in which like reference numerals indicate like components with respect to FIG. 1 and 2, a cross-sectional elevation view of the LCD glass assembly 13,14 of FIG. 1, is illustrated. The active matrix TFT structure 14 is formed on a glass substrate 40. A light shield 41 blocks transmission of light through the matrix 14, except primarily at the areas occupied by the pixel electrodes, such as pixel electrode 30. A TFT passivation layer 42 comprised of silicon dioxide ($SiO_2$) is formed on the substrate 40. As discussed above, the pixel electrode 30 is the drain electrode of the TFT 31. The source electrode for the TFT 31 is depicted at 43 and is also comprised of ITO. It is appreciated that the source electrode 43 is formed as part of the source bus-line 33 of FIG. 2. TFT layers 44 and 45 are comprised of phosphorus doped amorphous silicon (n+a-Si) and intrinsic amorphous silicon (i a-Si), respectively. The layer 45 is the TFT channeling layer and provides controllable conductivity between source and drain under control of the TFT gate. The layer 44 provides good ohmic contact between the semiconductor layer 45 and the source/drain electrodes. A pixel passivation layer 46 comprised of silicon nitride (SiNx) provides the gate insulator for the TFT 31 and the insulator for the storage capacitors. The gate electrode for the TFT 31 is indicated at 47 and is comprised of tantalum (Ta). It is appreciated that the gate electrode 47 is connected to the gate bus-line 32 of FIG. 2. A polymide (PI) alignment layer 48 completes the active matrix TFT structure 14.

The upper color filter layer 13 is constructed on a glass substrate 50. Each color triad of the active matrix is comprised of a BLUE color filter 51, a GREEN color filter 52 and a RED color filter 53. The RGB color filters are separated by a black matrix 54. In the preferred embodiment of the invention, the BLUE, GREEN and RED filters are 3.6 um, 2.6 um and 2.0 um thick, respectively. The upper LCD electrode is illustrated as common electrode 55 which is comprised of ITO. The common electrode 55 is separated from the color filters by an overcoat layer 56. An alignment layer 57, similar to the alignment layer 48, completes the structure of the substrate 13.

Liquid crystal material 60 fills the volume between the substrates 13 and 14. The substrate 13 is spaced from the substrate 14 to preferably provide a BLUE gap of from 3.5 to 5.0 um, a GREEN gap of from 5.0 to 6.0 um and a RED gap of from 5.6 to 6.7 um. These gaps are appropriate to tune the pixel cells to the BLUE, GREEN and RED wavelengths of 435 um, 545 um, and 610 um, respectively.

Figure 4:
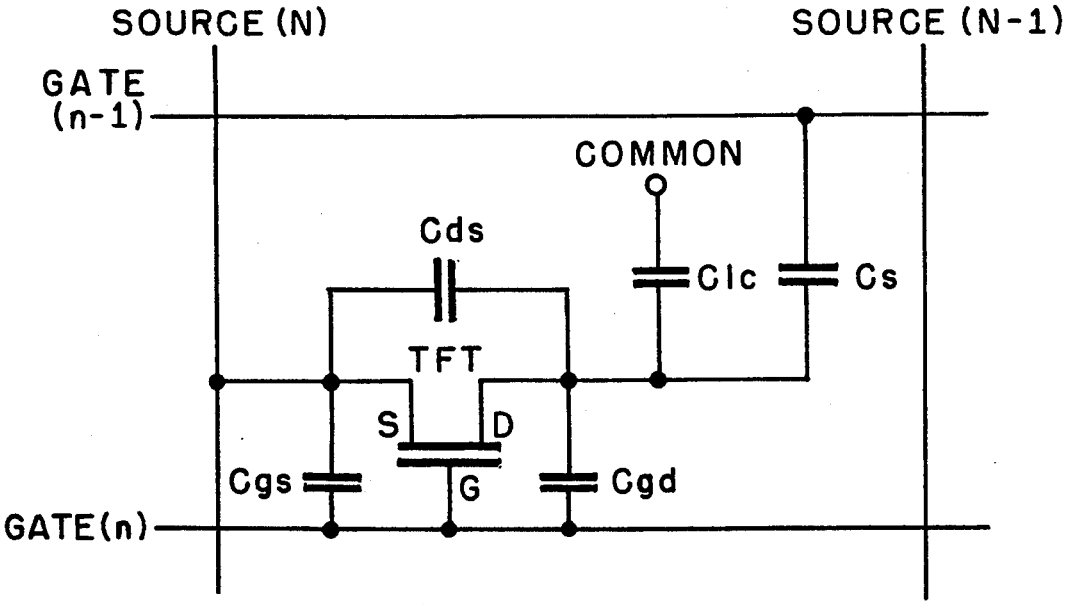
FIG. 4 is a schematic diagram of an electrical equivalent circuit of the pixel of the LCD.

Referring to FIG. 4, an electrical equivalent circuit of the pixel previously described is illustrated. Cgs is the gate-source capacitance of the TFT and Cds is the drain-source capacitance. Cgd is the gate-drain capacitance and Clc is the liquid crystal capacitance. Cs is the storage capacitance.

Figure 5:
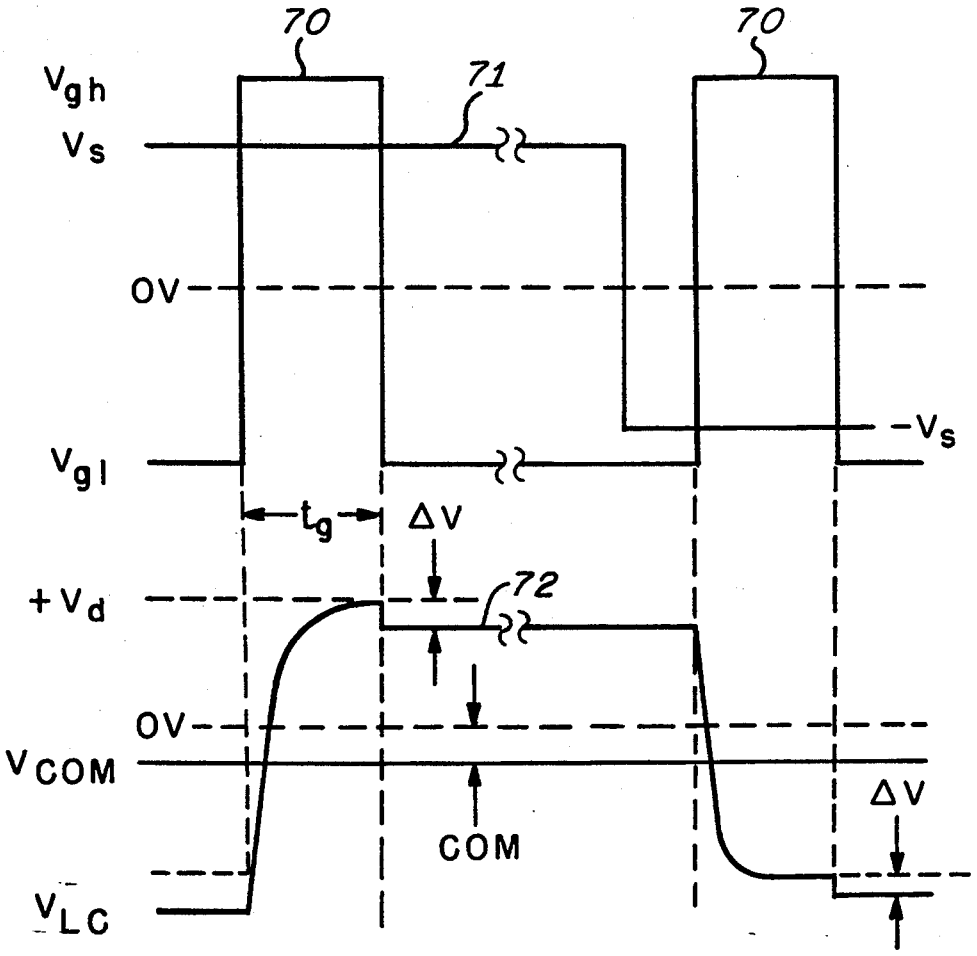
FIG. 5 is a waveform diagram illustrating the pixel voltage offset resulting from the gate pulse.

Referring to FIG. 5, the pixel offset voltage resulting from the gate pulse is illustrated. Pulses 70 are applied to the gate bus-lines in order to scan the matrix while +Vs or −Vs is applied to the source bus-lines as video information signals. The information signals are illustrated by waveform 71. Waveform 72 illustrates the drain voltage resulting from the gate pulses 70 and the source voltage 71. It is appreciated that the waveform 72 is asymmetric about zero volts with a net DC accumulation of Delta V as illustrated. As discussed above, image retention and flicker are caused by the parasitic capacitance Cgd between the gate electrode and the drain electrode of the TFT. The amount of DC is given by:

$$DCgd=[Cgd/(Cgd+Cs+Clc)](V_{gh}-V_{gl})$$

where DCgd=Delta V of FIG. 5.

The voltage Vcom is the voltage applied to the common LCD electrode to compensate for Delta V so as to reduce image retention and flicker. As discussed above, however, because of the different primary color cell gaps, Clc is different for each primary color. Therefore, there is not any value for Vcom that will properly compensate all of the color pixels for Delta V in the prior art multigap LCD technology. When, for example, applying a Vcom for minimal GREEN pixel DC offset voltage, significant DC charge is accumulated in the BLUE and RED pixels which induces DC offset voltages at the sites of the BLUE and RED pixels.

In accordance with the invention, the primary color pixels are modified to equalize the capacitance values thereof, thereby equalizing the offset voltages (Delta V) at the primary color pixels. With this modification, a single DC bias voltage (Vcom) can be applied to the common electrode 55 (FIG. 3) to reduce image retention and flicker. Two preferred structures are contemplated. Custom storage capacitors of differing values for the primary color pixels can be utilized to equalize the pixel offset voltages. The custom storage capacitors are formed at each of the primary color pixels to equalize the capacitance values thereof. Alternatively, differing LC capacitance values (i.e. pixel electrode sizes) for the primary color pixels to provide identical Delta V can be utilized.

Thus, in accordance with the invention, the DC content of the pixels in the multigap display are equalized and minimized by utilizing differing storage capacitance values for the primary color pixel storage capacitors. For an RGB triad display, this can be accomplished by utilizing custom storage capacitors for the RED, GREEN and BLUE pixels in accordance with the following relationship:

$$DC_{red}=[Cgd/(Clc_{red}+Cs_{red}+Cgd)](V_{gh}-V_{gl})$$

$$DC_{green}=[Cgd/(Clc_{green}+Cs_{green}+Cgd)](V_{gh}-V_{gl})$$

$$DC_{blue}=[Cgd/(Clc_{blue}+Cs_{blue}+Cgd)](V_{gh}-V_{gl})$$

$$DC_{red}=DC_{green}=DC_{blue}$$

where:

$Cs_{red}$=Storage Capacitance of the RED pixel $Cs_{green}$=Storage Capacitance of the GREEN pixel $Cs_{blue}$=Storage Capacitance of the BLUE pixel.

Referring to FIG. 6, an embodiment of the active matrix TFT substrate 14 is illustrated with custom storage capacitors. It is appreciated that the capacitance of storage capacitors 80 for RED pixels R is larger than the capacitance of storage capacitors 81 for GREEN pixels G. Similarly, the capacitance of storage capacitors 82 for the BLUE pixels B is smaller than the capacitance of the storage capacitors 81. In this manner, Delta V is equalized over the multigap display.

Alternatively, the DC content of the pixels in the multigap display can be minimized by providing differing capacitance values for the primary color pixels. In an RGB triad display, the DC content of the RED, GREEN and BLUE pixels can be equalized by adjusting the areas of the pixels in accordance with the following relationship:

$$Clc_{red}=Clc_{green}=Clc_{blue}.$$

This embodiment requires changing the proportions of the luminance of the primary colors by modifying the dye concentration in the filters or by modifying the phosphor content of the lamp 18 (FIG. 1).

Referring to FIG. 7, the active matrix TFT substrate 14 is illustrated with differing capacitance values for the primary color pixels by modifying the areas of the pixel electrodes. In the embodiment of FIG. 7, the storage capacitors for the primary color pixels are equal. It is appreciated that a combination of the two structures described with respect to FIG. 6 and 7 can be utilized in practicing the invention.

Offset voltage equalization may also be realized without altering the pixel electrode capacitance. This may be accomplished by the varying the gate-drain capacitance of the TFTs and the storage element capacitance in a manner to establish approximately equal ratios of the gate-drain capacitance to the sum of the pixel electrode capacitance, the storage capacitance, and the ate-drain capacitance, for the RED GREEN, and BLUE pixels. That is:

$$\frac{Cgd_{red}}{(Clc_{red}+Cs_{red}+Cgd_{red})}\approx\frac{Cgd_{green}}{(Clc_{green}+Cs_{green}+Cgd_{green})}\approx\frac{Cgd_{blue}}{(Clc_{blue}+Cs_{blue}+Cgd_{blue})}$$

It should be apparent that, offset voltage equalization may also be realized by varying all three capacitances, Clc, Cs, and Cgd, to satisfy the equal capacitance ratio criteria. It has been determined that the ratios of Cgd to Clc+Cs+Cgd are equal when the ratios of the RED, GREEN, and BLUE pixel electrode capacitance are equal to the ratios of the respective storage capacitances and the ratio of the respective gate-drain capacitances. That is:

$$Clc_{red}:Clc_{green}:Clc_{blue}=Cgd_{red}:Cgd_{green}:Cgd_{blue}=CS_{red}:Cs_{green}:CS_{blue}$$

Figure 8A:
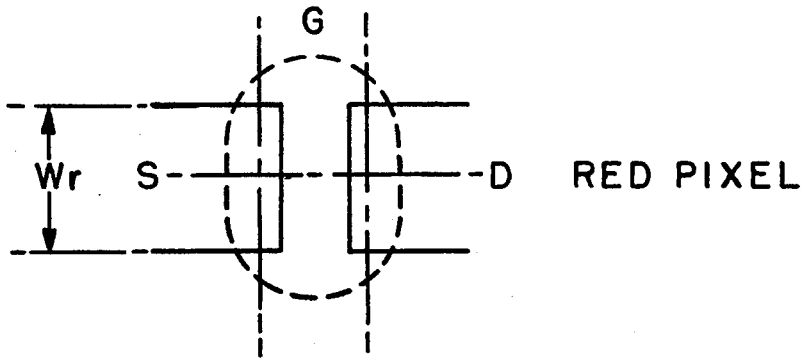
FIGS. 8A, 8B, and 8C are exploded views of the TFTs gate-drain and gate-source coupling region, illustrating geometries for varying the gate-drain capacitances.
Figure 8B:
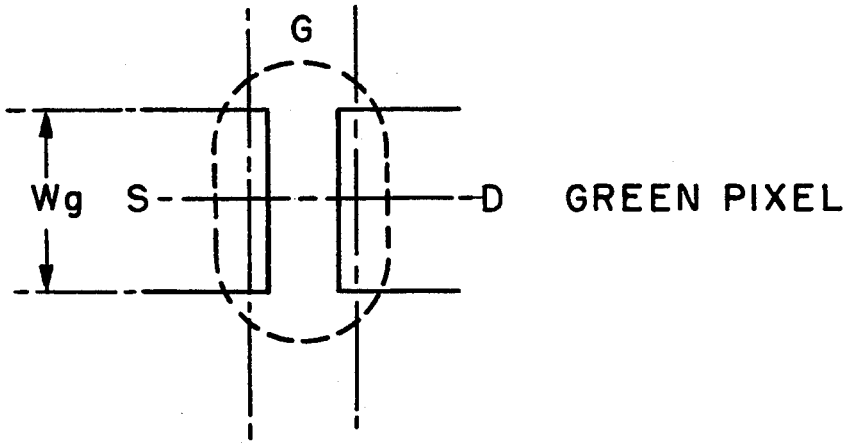
Figure 8C:
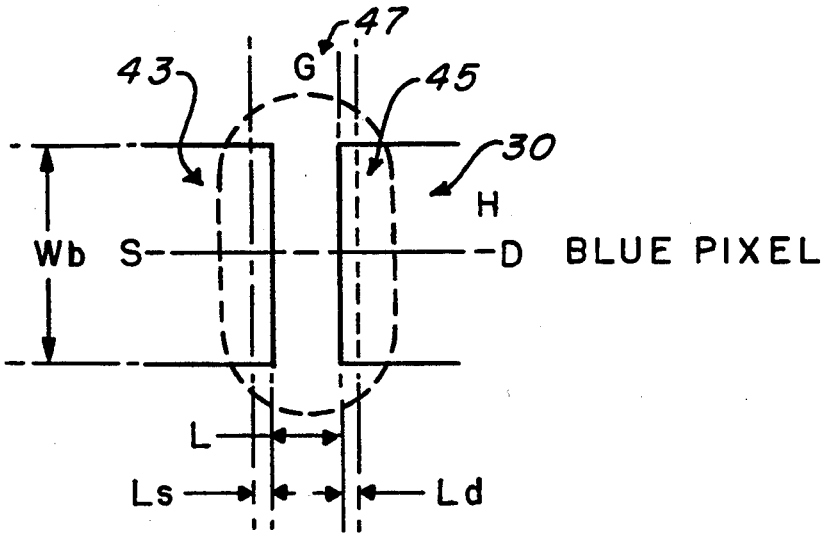

Refer now to FIGS. 8A, 8B, and 8C wherein exploded plane views of the TFTs are provided. In these figures like reference numerals indicate like components with respect to FIG. 3. As shown in the figures, the spacing L between the source 43 and the drain 30 and the overlap $L_d$ of the gate 47 by the drain 30 and the overlap Ls of the gate 47 by the source 43 along the axis H may be kept equal for all three pixels. Since the gate-drain capacitance is a function of the overlapping area of the gate and the drain, the gate-drain capacitance variation may be accomplished by altering the widths $W_R$, $W_G$, and $W_B$ to provide the desired RED, GREEN, and BLUE gate-drain capacitances. Though width variation is the preferred method of altering the gate-drain capacitance, it should be recognized that the gate-drain capacitance may also be varied by maintaining the width constant and varying the overlap $L_d$, or by varying both overlap and width.

While the invention has been described in its preferred embodiment, it is to be understood that the words which have been used are words of description rather than limitation and that changes may be made within the purview of the appended claims without departing from the true scope and spirit of the invention in its broader aspects.

We claim:

1. A multigap liquid crystal color display including a common electrode; a plurality of pixels, each having a pixel electrode facing a common electrode; a plurality of switches for respectively activating said pixel electrodes; means for applying an activation signal to each switch, thereby inducing offset voltages at said pixel electrodes; said pixels including first and second pixels for generating first and second colors, respectively; said first and second pixels having first and second cell gaps, respectively, said first cell gap being different from said second cell gap; said first and second pixels exhibiting first and second capacitances, respectively, resulting in first and second offset voltages at pixel electrodes of said first and second pixels, respectively, characterized in that:

said electrodes of said first and second pixels are constructed and arranged to equalize said first and second offset voltages, thereby establishing an electrode offset voltage at said first and second pixels electrodes; and in that it further includes means for providing a source bias voltage, said source bias voltage being applied to said common electrode to minimize said electrode offset voltage.

2. The display of claim 1 wherein each said switch comprises a transistor switch, said activation signal being applied to an electrode thereof.

3. The display of claim 2 wherein each said transistor switch comprises a TFT with a gate electrode and a drain electrode, said drain electrode being electrically connected with said pixel electrode, said activation signal being applied to said gate electrode.

4. The display of claim 1, further including first and second storage capacitors coupled to said pixel electrodes of said first and second pixels, respectively, said first and second storage capacitors having capacitance values different with respect to each other, said capacitance values of said first and second storage capacitors chosen to equalize said first and second offset voltages.

5. The display of claim 1 wherein said pixel electrodes of said first and second pixels have different areas with respect to each other such that respective different pixel capacitance values for said first and second pixels are provided.

6. The display of claim 1 wherein:

said pixels include third pixels for generating a third color, said pixels having a third cell gap different from said first and second cell gaps, said third gap establishing a third capacitance, resulting in a third offset voltage at electrodes of said third pixels, said electrodes of said third pixels constructed and arranged so that said third offset voltage equals said electrode voltage;

third storage capacitors coupled to said electrodes of said third pixels; and wherein said first, second and third storage capacitors have values in accordance with:

$$DC_1=[Cgd/(Clc_1+Cs_1+Cgd)](V_{pp})$$

$$DC_2=[Cgd/(Clc_2+CS_2+Cgd)](V_{pp})$$

$$DC_3=[Cgd/(Clc_3+Cs_3+Cgd)](V_{pp})$$

$$DC_1=DC_2=DC_3$$

where $DC_1$=said first offset voltage $DC_2$=said second offset voltage $DC_3$=said third offset voltage Cgd=gate-drain capacitance voltage $Clc_1$=liquid crystal capacitance of said pixel electrode of said first pixel with respect to said common electrode $Clc_2$=liquid crystal capacitance of said pixel electrode of said second pixel with respect to said common electrode $Clc_3$=liquid crystal capacitance of said pixel electrode of said third pixel with respect to said common electrode $V_{pp}$=peak-to-peak voltage of said activation signal $Cs_1$=said capacitance value of said first storage capacitors $Cs_2$=said capacitance value of said second storage capacitors $Cs_3$=said capacitance value of said third storage capacitors.

7. The display of claim 1 wherein said pixels include third pixels for generating a third color, said third color pixels having a third cell gap, said third cell gap being different from said first and second cell gaps, said third pixels exhibiting a third capacitance resulting in a third offset voltage at said electrodes of said third pixels, said pixel electrodes of said first, second and third pixels having different areas with respect to each other so that said first, second and third offset voltages are equal with respect to each other and so that:

$$Clc_1=Clc_2=Clc_3$$

where:

$Clc_1$=liquid crystal capacitance betwen said pixel electrodes of said first pixels and said commmon electrode $Clc_2$=liquid crystal capacitance between said pixel electrodes of said second pixels and said common electrode $Clc_3$=liquid crystal capacitance between said pixel electrodes of said third pixels and said common electrode.

8. The display of claim 1 wherein said plurality of switches includes first and second transistor switches respectively coupled to said first and second pixels, each including a TFT having a gate electrode and a drain electrode and a capacitance Cgd therebetween, thereby providing a first gate-drain capacitance $Cgd_1$ and a second gate-drain capacitance $Cgd_2$, respectively and further including first $Cs_1$ and second $Cs_2$ storage capacitances respectively coupled to said pixel electrodes of said first and second pixels and wherein $Cgd_1+Cs_1$ and $Cgd_2+Cs_2$ provide different capacitance values with respect to each other, said capacitance values of Cgd1+Cs1 and Cqd2+Cs2 are chosen to equalize said first and second offset voltages.

9. The display of claim 1 wherein said pixels include a third pixel for generating a third color, said third pixel having a third cell gap different from said first and second cell gaps so that said first, second, and third pixels exhibit electrode capacitances having different capacitance values;

said plurality of switches include three transistor switches respectively coupled to said three pixels, each including a TFT having a gate electrode and a drain electrode and a gate-drain capacitance therebetween, said gate drain-capacitance values being different for each TFT; and further including first, second, and third storage capacitors coupled respectively to said first, second, and third pixels, said first, second, and third storage capacitors having capacitance values different with respect to each other;

said electrodes, said gate-drain capacitances, and said storage capacitances adjusted such that $$\frac{Cgd_1}{(Clc_1+Cs_1+Cgd_1)}=\frac{Cgd_2}{(Clc_2+Cs_2+Cgd_2)}=\frac{Cgd_3}{(Clc_3+Cs_3+Cgd_3)}$$

where: $Cgd_1$, $Cgd_2$, and $Cgd_3$ respectively equal said capacitor value of said gate-drain capacitances of said three transistor switches, $Clc_1$, $Clc_2$, and $Clc_3$ respectively equal said capacitance value of said electrode capacitances of said three pixels, and $Cs_1$, $Cs_2$, and $Cs_3$ respectively equal said first, second, and third capacitance value of said storage capacitors.

10. The display of claim 9 wherein said electrode capacitance values, said gate-drain capacitance values, and said storage capacitance values are have the relationship $$Clc_1:Clc_2:Clc_3=Cgd_1:Cgd_2:Cgd_3=Cs_1:Cs_2:Cs_3.$$

* * * * *

UNITED STATES PATENT AND TRADEMARK OFFICE

CERTIFICATE OF CORRECTION

PATENT NO. : 5,402,141

DATED : March 28, 1995

INVENTOR(S) : Elias S. Haim, Tomihisa Sunata

It is certified that error appears in the above-indentified patent and that said Letters Patent is hereby corrected as shown below:

Column 9, line 6, cancel "$DC_2$=[Cgd/($Clc_2$+$CS_2$+Cgd)]($V_{PP}$)" and substitute --$DC_2$=[Cgd/($Clc_2$+$Cs_2$+Cgd)]($V_{PP}$)--;
line 37, cancel "color pixels" and substitute --pixels--;
line 42, cancel "said electrodes" and substitute -- electrodes--.

Column 10, line 16, cancel "Cqd2+Cs2" and substitute --Cgd2+Cs2--.

Signed and Sealed this

Fifth Day of September, 1995

*Attest:*

Bruce Lehman

BRUCE LEHMAN

*Attesting Officer*

*Commissioner of Patents and Trademarks*